United States Patent [19]

Hirayama

[11] Patent Number: 4,873,914

[45] Date of Patent: Oct. 17, 1989

[54] CLEAN ROOM SYSTEM AND UNIT FOR THE SAME CLEAN ROOM SYSTEM

[75] Inventor: Shoji Hirayama, Yamato, Japan

[73] Assignee: Hirayama Setsubi Kabushiki Kaisha, Japan

[21] Appl. No.: 152,367

[22] Filed: Feb. 4, 1988

[51] Int. Cl.[4] ..... F24F 9/00

[52] U.S. Cl. ..... 98/31.6; 55/385.2

[58] Field of Search ..... 98/31.5, 31.6, 34.5, 98/34.6, 36, 115.3; 55/385 A, 484

[56] References Cited

U.S. PATENT DOCUMENTS

| | | | |
|---|---|---|---|
| 4,129,122 | 12/1978 | Dout et al. | 98/36 X |
| 4,409,889 | 10/1983 | Burleson | 98/31.5 |
| 4,667,580 | 5/1987 | Wetzel | 98/34.6 |

FOREIGN PATENT DOCUMENTS

| | | | |
|---|---|---|---|
| WO85/04240 | 9/1985 | PCT Int'l Appl. | 98/115.3 |
| 669866 | 4/1952 | United Kingdom | 98/31.6 |

OTHER PUBLICATIONS

"IBM Technical Disclosure Bulletin", vol. 14, No. 10, Mar. 1977.

*Primary Examiner*—Harold Joyce
*Attorney, Agent, or Firm*—Oliff & Berridge

[57] ABSTRACT

A unit for a clean room system of substantially inverted L-shaped cross section having a hollow ceiling, and a hollow wall communicating at the upper end thereof with the ceiling and at the lower end thereof with the floor in the room. An air purifying filter is disposed at the front of the ceiling, and a cold water supplying conduit for an air conditioner control unit is located at the rear of the ceiling. A clean room system has a plurality of the units. Thus, the clean room can be simply and rapidly constructed without the necessity of a large space at the back side of a ceiling or under a floor to accommodate air conditioning ducts, thereby lowering the height of a building as compared to a conventional one, even if a 2-story or 3-story clean room is constructed. Further, the layout, such as a volume and shape in the room can be freely modified and uniform temperature and moisture can be maintained in the clean room.

1 Claim, 4 Drawing Sheets

CLEAN ROOM SYSTEM AND UNIT FOR THE SAME CLEAN ROOM SYSTEM

BACKGROUND OF THE INVENTION

This invention relates to a bacterial and dustfree clean room system required for a semiconductor production industry or a foodstuff industry.

A conventional clean room has, as shown in FIG. 5, a filter unit B provided in a ceiling of a room A, and an air conditioner control unit C for supplying air through the filter unit B into the room by the air conditioner control unit C to air condition and clean the air in the room, or, as shown in FIG. 6, a filter unit B provided in a ceiling, an air circulating fan D disposed near the filter unit B, and an air conditioner control unit C provided out of the room to air condition the air in the room and to clean the air as a central type.

However, since the central type clean room provided one air conditioner control unit out of the room to control the air condition of the entirety of the clean room, it must pipe a plurality of ducts of large diameter at the back side of the ceiling or under the floor thereby necessitating a sufficient space for the ducts at the back side of the ceiling or under the floor. Thus, when a 2-story or 3-story clean room is constructed, a considerably high building is required to accomodate the ducts.

When the room is air conditioned by one air conditioner control unit like the above-mentioned central type, in case of a wide volume clean room, the central type cannot uniformly maintain the entire temperature and moisture in the room to eliminate the irregular internal heat generation due to the wide volume, and it is difficult to obtain satisfactory air condition. Further, the central type clean room must newly construct the clean room by damaging the entire clean room when modifying the layout in the room, such as the area and the configuration of the clean room.

SUMMARY OF THE INVENTION

Accordingly, an object of the present invention is to provide a clean room system in which a clean room can be simply and rapidly constructed without the necessity of a large space at the back side of a ceiling or under a floor thereby lowering the height of a building compared to a conventional building even if 2-story or 3-story clean room is constructed. Further the layout, such as a volume and a shape in the room can be partly freely modified and uniform temperature and moisture can be maintained in the clean room.

In order to achieve the above object, there is provided according to this invention a unit for a clean room system of substantially inverted L-shaped cross section having a hollow ceiling, and a hollow wall communicating at the upper end thereof with the ceiling and at the lower end thereof with the floor in the room, the hollow ceiling comprising an air purifying filter disposed at the front located inside the room of the ceiling, an air fan located downstream of the filter, air conditioner control unit adjacent to and upstream of the air fan, and a cold water supplying conduit for the air conditioner control unit at the rear of the ceiling.

In order to further achieve the other aspect of this invention, there is also provided according to this invention a clean room system comprising a plurality of units of substantially inverted L-shaped cross section each having a ceiling and a wall suspended from the rear of the ceiling and connected at the ends and the sides of the ceilings laterally and longitudinally, floors arranged for communication with the hollows, wall plates arranged at the endmost units to walls of each unit form enclosed rooms, each unit having a filter at the front of the ceiling, an air fan, an air conditioner control unit and a cold water supplying conduit provided at the rear of the ceiling in such a manner that the cold water supplying conduits of the respective units are connected by connecting means, the cold water supply source is connected to at least one cold water supplying conduit to supply cold water to cold water supplying conduits, thereby cleaning and air condition-controlling the respective units independently.

BRIEF DESCRIPTION OF THE DRAWINGS

The above and other related objects and features of the invention will be apparent from a reading of the following description of the disclosure found in the accompanying drawings and novelty thereof pointed out in the appended claims.

DESCRIPTION OF THE PREFERRED EMBODIMENTS

An embodiment of this invention will be described in detail with reference to the accompanying drawings.

Figure 1:
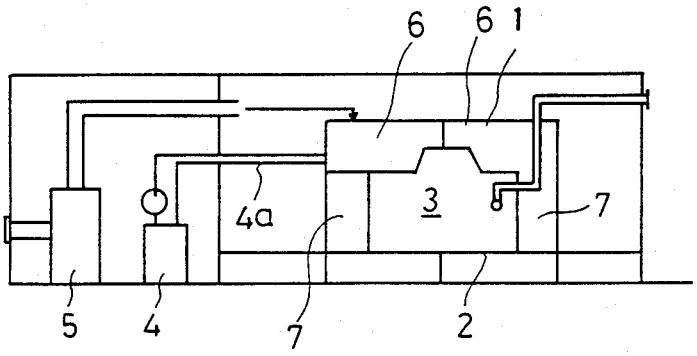
FIG. 1 is a schematic view showing an embodiment of a clean room according to the present invention.

In a clean room system of this invention as shown in FIG. 1, units 1 of inverted L-shaped cross section are connected laterally and longitudinally, and a floor 2 is provided to construct a clean room 3. A cold water supply source 4 for supplying cold water to an air conditioner control unit and an outer air conditioner 5 for intaking atmospheric air into the room 3 are provided as required and are disposed out of the room 3.

Figure 2:
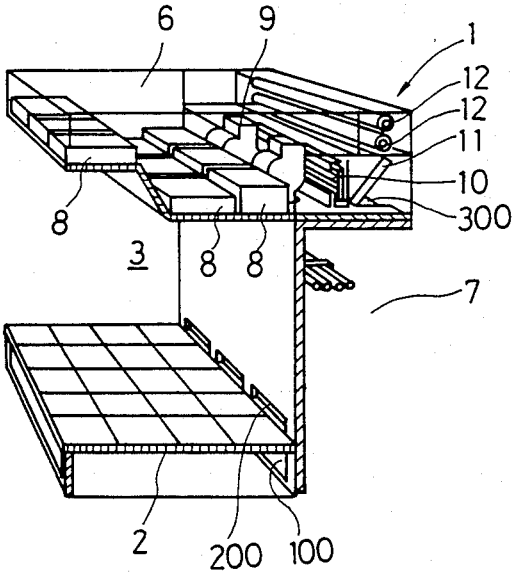
FIG. 2 is a perspective view of a unit for forming the clean room system.
Figure 3:
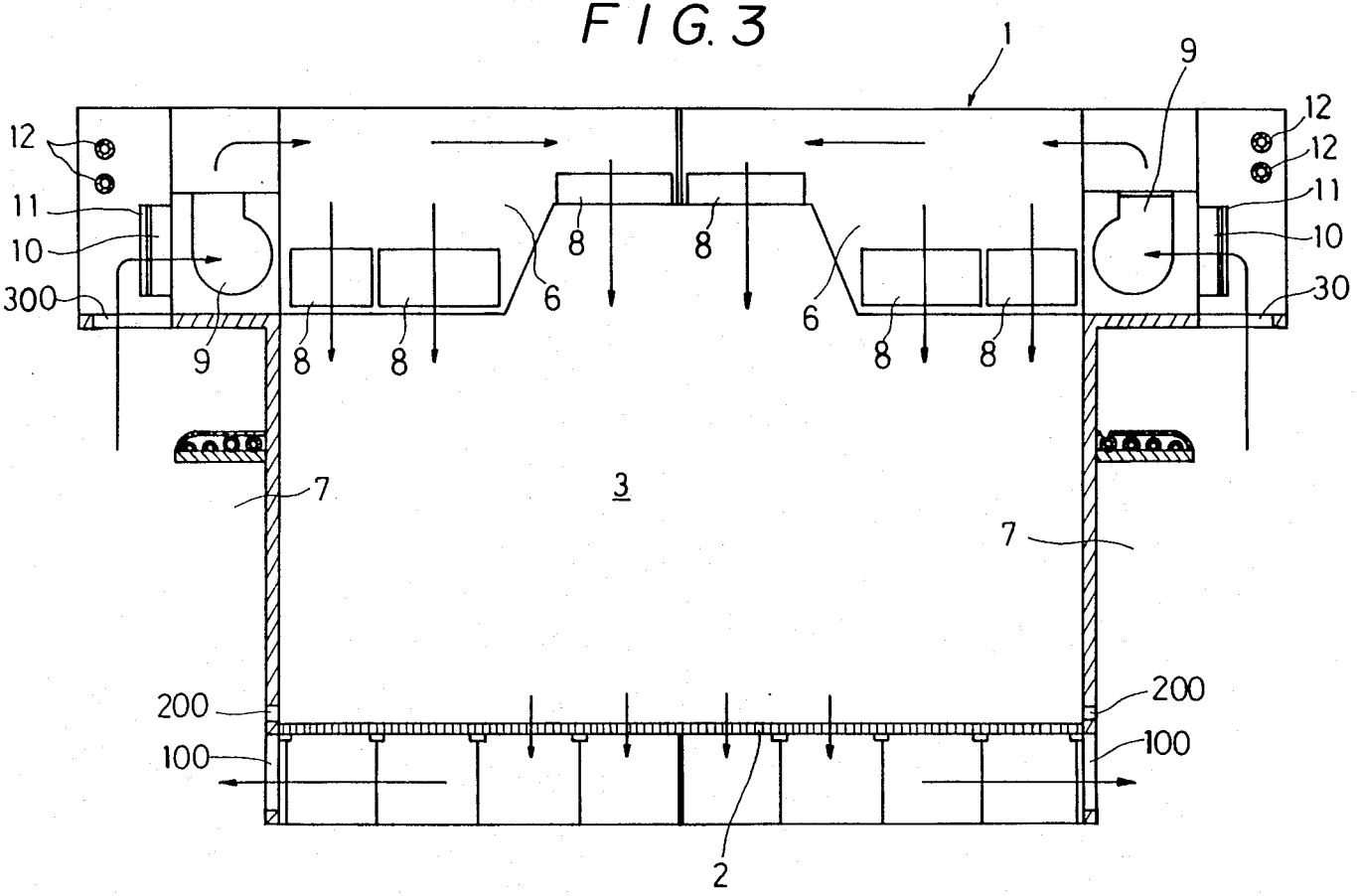
FIG. 3 is an enlarged sectional view of the clean room composed of units of FIG. 2.
Figure 4:
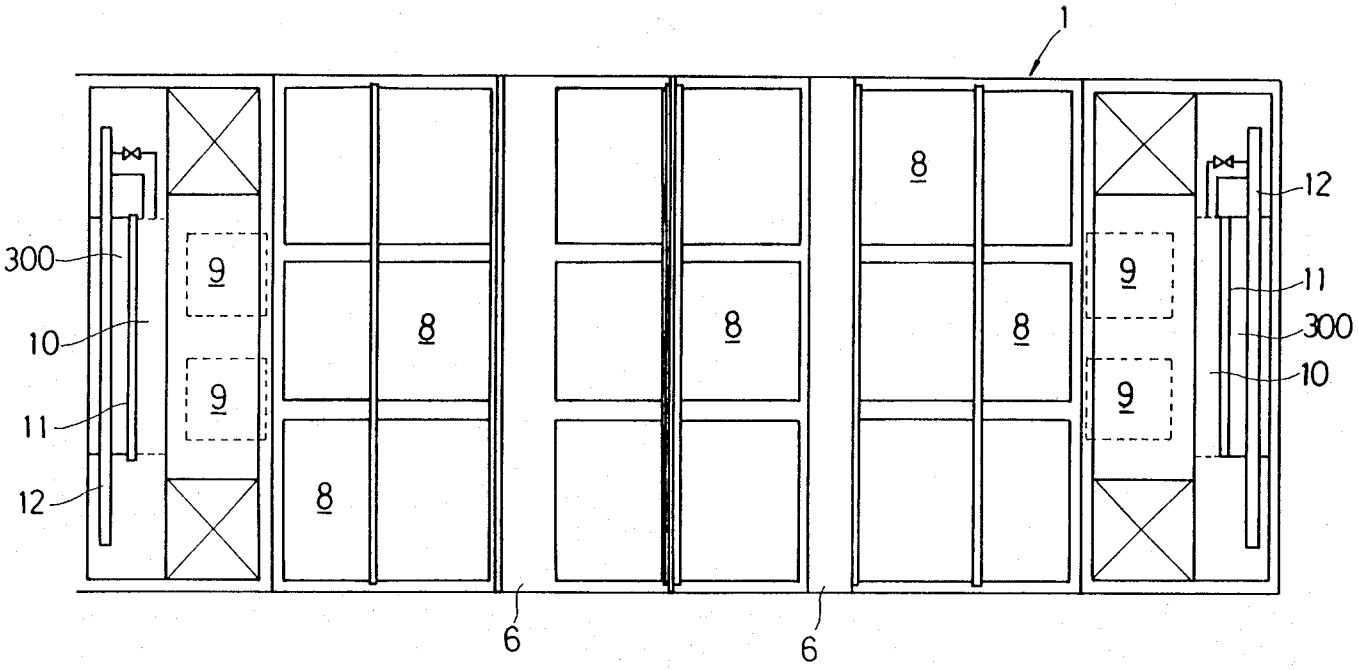
FIG. 4 is a plan view of the clean room.
Figure 5:
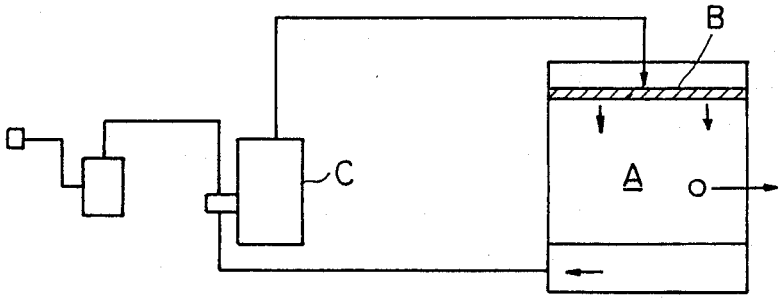
FIG. 5 PRIOR ART
FIGS. 5 and 6 are schematic views of a conventional clean room.
Figure 6:
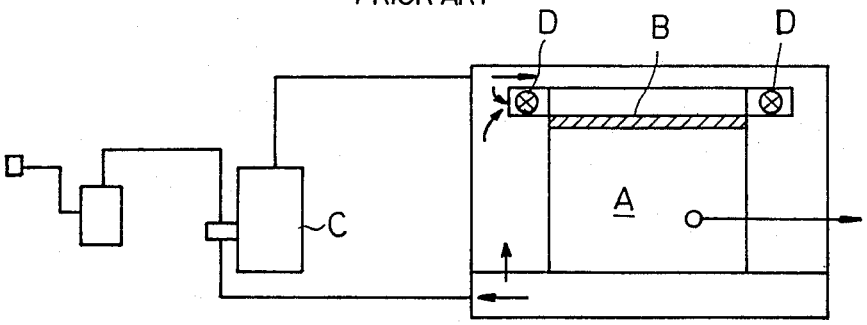
FIG. 6 PRIOR ART

FIG. 2 shows the unit 1 for constructing the clean room system, and FIGS. 3 and 4 are enlarged sectional and plan views of the clean room formed of the units 1.

Each unit 1 has a hollow ceiling 6, and a hollow wall 7 suspended from the rear of the ceiling 6 at least in a substantially inverted L-shaped cross section. The wall 7 communicates at its upper end with the rear of the ceiling 6 and at its lower end with the floor 2 in the room 3.

An air purifying first air diffusing filter 8 is provided at the front of the ceiling inside the room. An air fan 9 is provided at the rear of the ceiling for feeding air through the filter 8 into the room 3. Thus, the air fed into the room is recirculated by the fan 9 to flow below the floor 2 through the hollow wall member and back into the room. When the air in the room is partially exhausted out of the room, atmospheric air is taken in by the outer air conditioner into the room.

The cooling coil of the air conditioner control unit 10 is disposed at the rear of the fan 9, and the unit 10 regulates the temperature and the moisture in each unit. Further, a second filter 11 is disposed at the rear of the air conditioner control unit 10 for purifying the air to clean the air fed into the room by the first filter 8.

A cold water supplying conduit 12 is composed of a cold water feeding conduit for supplying cold water to the air conditioner control unit 10 and a cold water returning conduit. The conduit 12 is attached to a supporting member to be arranged, and connected to the air conditioner control unit. The conduit 12 has a suitable length to be contained in the rear of the ceiling and is opened at both ends.

In FIG. 3, an arrow indicates the air flow.

The clean room system of this invention is constructed by connecting a plurality of units constructed as described above as shown in FIGS. 3 and 4.

More specifically, the units 1 are laterally connected at the ends of the ceilings thereof by connecting means, and also connected at the sides longitudinally. The floor 2 is disposed under the units, and wall plates (not shown) are arranged at the sides of the units 1 disposed at the sidemost ends to construct a clean room.

As described above, when a plurality of units are connected laterally and longitudinally, the cold water conduits internally provided at the same height in the respective units are connected by flexible joints or flanges. The conduit 4*a* of the cold water supply source 4 disposed out of the room is connected to the cold water supplying conduit of the unit at the sidemost end. As described above, each unit has a cold water supplying conduit for supplying cold water to each air conditioner control unit. Thus, only two conduits of cold water feeding tube and cold water returning conduits are connected to the cold water supplying conduit of the unit of the sidemost end, so excessive conduits are not necessary.

The above-mentioned unit is formed of the ceiling and the wall of substantially inverted L-shaped cross section. However, this invention is not limited to the particular embodiment described above. For example, the ceiling, the wall and a substantially U-shaped cross section integral with a floor at the lower end of the wall may be employed. In this case, the respective units are connected laterally and longitudinally to form a clean room. Thus, floor forming work is not required, and the clean room can be further easily and rapidly constructed.

According to the present invention as described above, each unit has the air conditioner control unit, the air fan, and a cold water supplying conduit connected to the air conditioner control unit to eliminate excessive conduits and to thus eliminate the necessity of increasing the space at the back side of the ceiling or under the floor. Thus, when 2-story or 3-story clean room is, for example, constructed, the height of the building can be lowered as compared with the conventional clean room.

Further, since the clean room can be constructed merely by connecting the units, a term for constructing the clean room can be largely shortened, and the shape and the volume of the clean room can be simply modified. Since the air conditioner control unit is provided in each unit, uniform temperature and moisture can be maintained in the entire clean room.

What is claimed is:

1. A clean room system comprising:

a plurality of cleaning units each comprising:

a conduit having a substantially inverted L-shaped cross-section defining a hollow ceiling and a hollow wall extending from a rear end of said ceiling to a floor, the hollow wall communicating at an upper end thereof with the hollow ceiling and at a lower end threof with the floor of the room to create an air flow path for directing air from said hollow wall through said hollow ceiling and into said room and recirculating air from said room through said floor and into said hollow wall;

an air purifying filter disposed at a front end of the hollow ceiling to purify air passing between said hollow ceiling and said room;

an air fan located in said hollow ceiling upstream of said filter in said air flow path;

an air conditioner control unit located in the rear end of the hollow ceiling adjacent to and upstream of said air fan in said air flow path;

cold water supply and return conduits for providing communication between said air conditioner control unit and a cold water supply source located outside said room, said cold water supply and return conduits having a predetermined length and being located at the rear end of said hollow ceiling upstream of said air conditioner in the air flow path; and each cleaning unit being connected laterally and longitudinally to an adjacent cleaning unit at ends and sides of the hollow ceiling and hollow wall of each cleaning unit;

a corresponding plurality of hollow floor systems each connected for communicating with a hollow wall of a corresponding cleaning unit;

opposing wall plates each connected to an endmost cleaning unit and corresponding floor system to define an enclosed room; and connecting means for connecting the cold water supply and return conduits of one cleaning unit with the corresponding cold water supply and return conduits of an adjacent cleaning unit, the cold water supply and return conduits of one endmost cleaning unit being connected to said cold water supply source.

* * * * *